US009391390B2

(12) United States Patent
Endo et al.

(10) Patent No.: US 9,391,390 B2
(45) Date of Patent: Jul. 12, 2016

(54) SPRING CONNECTOR WITH WATERPROOFING FUNCTION

(71) Applicant: YOKOWO CO., LTD, Tokyo (JP)

(72) Inventors: Kenji Endo, Tokyo (JP); Shingo Orikasa, Tokyo (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 14/372,265

(22) PCT Filed: Dec. 28, 2012

(86) PCT No.: PCT/JP2012/084146

§ 371 (c)(1),
(2) Date: Jul. 15, 2014

(87) PCT Pub. No.: WO2013/108579

PCT Pub. Date: Jul. 25, 2013

(65) Prior Publication Data

US 2014/0377986 A1 Dec. 25, 2014

(30) Foreign Application Priority Data

Jan. 16, 2012 (JP) ..... 2012-005979

(51) Int. Cl.
*H01R 13/52* (2006.01)
*H01R 13/17* (2006.01)
(Continued)

(52) U.S. Cl.
CPC ..... *H01R 13/5219* (2013.01); *H01R 4/48* (2013.01); *H01R 13/17* (2013.01); *H01R 13/2421* (2013.01); *H01R 13/521* (2013.01); *H01R 13/5224* (2013.01); *H01R 12/714* (2013.01)

(58) Field of Classification Search
CPC .... H01R 13/17; H01R 13/24; H01R 13/5219; H01R 13/5224; H01R 43/24; H01R 4/48; H01R 33/96
USPC ..... 439/66
See application file for complete search history.

(56) References Cited

U.S. PATENT DOCUMENTS 4,223,586 A * 9/1980 Miller ..... 411/15
4,894,495 A * 1/1990 Toda ..... 200/51.12
(Continued)

FOREIGN PATENT DOCUMENTS

EP 1 326 308 A1 9/2003
JP 08-287985 A 11/1996
(Continued)

OTHER PUBLICATIONS

International Search Report issued in corresponding International Patent Application No. PCT/JP2012/084146 dated Feb. 26, 2013.
(Continued)

*Primary Examiner* — Amy Cohen Johnson
*Assistant Examiner* — Oscar C Jimenez
(74) *Attorney, Agent, or Firm* — Morgan, Lewis & Bockius LLP

(57) ABSTRACT

A spring connector with waterproofing function includes a conductive tube having a distal end that is a contact part to be contacted with an object at one side; a conductive pin having a distal end that is a contact part to be contacted with an object at the other side, and protruded from an opening at a base end of the conductive tube; a spring held inside the conductive tube, and pressing the conductive pin to urge the conductive pin so as to protrude from the conductive tube; and an elastic member having a hole into which the conductive tube is inserted to be brought into tight contact with a side face of the conductive tube, the elastic member being spread in a flange-like shape from the side face of the conductive tube.

10 Claims, 4 Drawing Sheets

(51) Int. Cl.

| | |
|---|---|
| ***H01R 4/48*** | (2006.01) |
| ***H01R 13/24*** | (2006.01) |
| ***H01R 12/71*** | (2011.01) |

(56) References Cited

U.S. PATENT DOCUMENTS

| | | | | |
|---|---|---|---|---|
| 5,509,813 | A * | 4/1996 | Lu | 439/79 |
| 6,464,511 | B1 | 10/2002 | Watanabe et al. | |
| 7,641,516 | B1 | 1/2010 | Scott et al. | |
| 7,695,285 | B2 * | 4/2010 | Sugiura et al. | 439/66 |
| 2011/0159750 | A1 | 6/2011 | Christ et al. | |

FOREIGN PATENT DOCUMENTS

| | | | |
|---|---|---|---|
| JP | 2000-021468 | A | 1/2000 |
| JP | 2000-102179 | A | 4/2000 |
| JP | 2007-173073 | A | 7/2007 |
| JP | 2009-059586 | A | 3/2009 |

OTHER PUBLICATIONS

European Search Report issued in European Patent Application No. 12866367.1 on Sep. 4, 2015.

* cited by examiner

SPRING CONNECTOR WITH WATERPROOFING FUNCTION

TECHNICAL FIELD

The present invention relates to a spring connector with waterproofing function which is used for electrical connection, and has a structure for preventing intrusion of water drops.

BACKGROUND ART

In a spring connector for assuring electrical connection in a medical appliance such as an instillation device which is used in a medical field, for example, waterproofing function for preventing intrusion of liquid such as medicine into the appliance is required. The below described Patent Document 1 discloses a drip-proofing connector for electrically connecting a circuit board of a pulmonic dosing appliance and a cartridge to each other. This drip-proofing connector "includes a hollow body pin 11 which is press-fitted into a mounting hole 2 in a housing 1 to be engaged and fixed there, a movable pin 12 which is reciprocally inserted into this body pin 11, and a coil spring 17 which is interposed between an inner bottom face of the body pin 11 and a bottom face of the movable pin 12" (paragraph [0020] in Patent Document 1), and has such a structure that a drip-proofing cover 20 (silicone rubber or the like) is tightly fitted to an engaging groove 16 on a side face of the movable pin 12 (paragraph [0027] in Patent Document 1).

PRIOR ART DOCUMENT

Patent Document

Patent Document 1: JP-A-2007-173073

SUMMARY OF THE INVENTION

Problems that the Invention is to Solve

It is described that in the drip-proofing connector in Patent Document 1, "the bottom face of the movable pin 12 is inclined at an angle of 10 to 30°, and the coil spring 17 is pressure contacted with this bottom face thereby to bring an inner peripheral face of the body pin 11 and a peripheral face of the movable pin 12 into contact with each other. Therefore, the contact is reliably performed, and extremely favorable conductivity and low resistance can be obtained" (paragraph [0032] in Patent document 1). However, in the drip-proofing connector in Patent Document 1, because the drip-proofing cover 20 is tightly fitted to the engaging groove 16 on the side face of the movable pin 12, as described above, tilting movement of the movable pin 12 is hindered by the drip-proofing cover 20, even though the bottom face of the movable pin 12 is inclined. Therefore, it is difficult, in fact, to obtain the reliable contact between the inner peripheral face of the body pin 11 and the peripheral face of the movable pin 12 (accordingly, the reliable contact between objects to be contacted).

The invention has been made in view of the above described circumstances, and an object of the invention is to provide a spring connector with waterproofing function which is capable of making more reliable contact as compared with the prior art.

Means for Solving the Problems

According to one embodiment of the invention, there is provided a spring connector with waterproofing function comprising:

a conductive tube having a distal end which is a contact part to be contacted with an object at one side;

a conductive pin having a distal end which is a contact part to be contacted with an object at the other side, and protruded from an opening at a base end of the conductive tube, a base end of the conductive pin which is contained in the conductive tube and can slide with respect to the conductive tube, a part of a base end face of the conductive pin which is formed as an inclined face that is inclined with respect to a plane perpendicular to an axial direction;

a spring held inside the conductive tube, and pressing the inclined face of the conductive pin to urge the conductive pin so as to protrude from the conductive tube; and an elastic member having a hole into which the conductive tube is inserted to be brought into tight contact with a side face of the conductive tube, the elastic member being spread in a flange-like shape from the side face of the conductive tube.

The spring connector with waterproofing function comprises a housing having a hole for supporting at least a part of the side face of the conductive tube at a side close to the base end than the elastic member, and the distal end of the conductive pin may protrude from the hole in the housing, in a state where the distal end of the conductive pin is not in contact with the object.

The side face of the conductive tube and an inner face of the hole of the housing are respectively provided with convex parts, and by engaging the convex parts with each other, a maximal value of a protruding amount of the distal end of the conductive tube may be restricted.

The convex part of the conductive tube has a taper part which is reduced in diameter in a taper shape toward the base end side, and the conductive tube can be inserted into the hole of the housing from the base end side.

The hole of the housing has a small diameter hole part and a large diameter hole part which are continued in order from the base end side of the conductive tube, the conductive tube has a small diameter part which is positioned or extended inside the small diameter hole part, and a large diameter part which is positioned or extended inside the large diameter hole part, and when the distal end of the conductive pin is pushed in so as not to protrude from the hole, a part of the large diameter part of the conductive tube may remain in the large diameter hole part.

The spring connector with waterproofing function further includes a cover having a hole for exposing the distal end of the conductive tube, and covered over the housing from the distal end side of the conductive tube, wherein the distal end of the conductive tube can protrude from the hole of the cover, in a state where the distal end of the conductive tube is not in contact with the object, and wherein the elastic member may be clamped and pressed between the housing and the cover from both sides of an axial direction of the conductive tube.

The conductive tube has a concave groove which encircles the side face of the conductive tube, and the elastic member may be fitted into the concave groove in elastic contact with the concave groove.

The elastic member may be in elastic contact with a bottom face and both side faces of the concave groove at an entire circumference of the concave groove.

A non-elastic ring which surrounds an outside of the hole of the elastic member may be integrally provided with the elastic member or be fitted into the elastic member.

The base end of the conductive tube is formed as a caulked part, while the conductive pin has a large diameter part having a larger diameter than an inner diameter of the caulked part, at the base end side, and by engaging the large diameter part of the conductive pin with the caulked part, withdrawal of the conductive pin from the conductive tube may be prevented.

When the distal end of the conductive pin is pushed and the spring is contracted, a side face of the conductive pin at the base end side may be pressed against an inner face of the conductive tube.

It is to be noted that optional combinations of the above described constituent elements, and descriptions of the invention which are converted between methods and systems are also effective as the features of the invention.

Advantage of the Invention

According to the invention, the elastic member is provided on the conductive tube, while an elastic member for waterproofing is not provided on the conductive pin. For this reason, tilting movement of the conductive pin is not hindered by the elastic member, and the conductive pin can be pressed against the inner face of the conductive tube with a sufficient side pressure. As the results, it is possible to realize the spring connector with waterproofing function which is capable of making more reliable contact as compared with the prior art.

MODE FOR CARRYING OUT THE INVENTION

Figure 1:
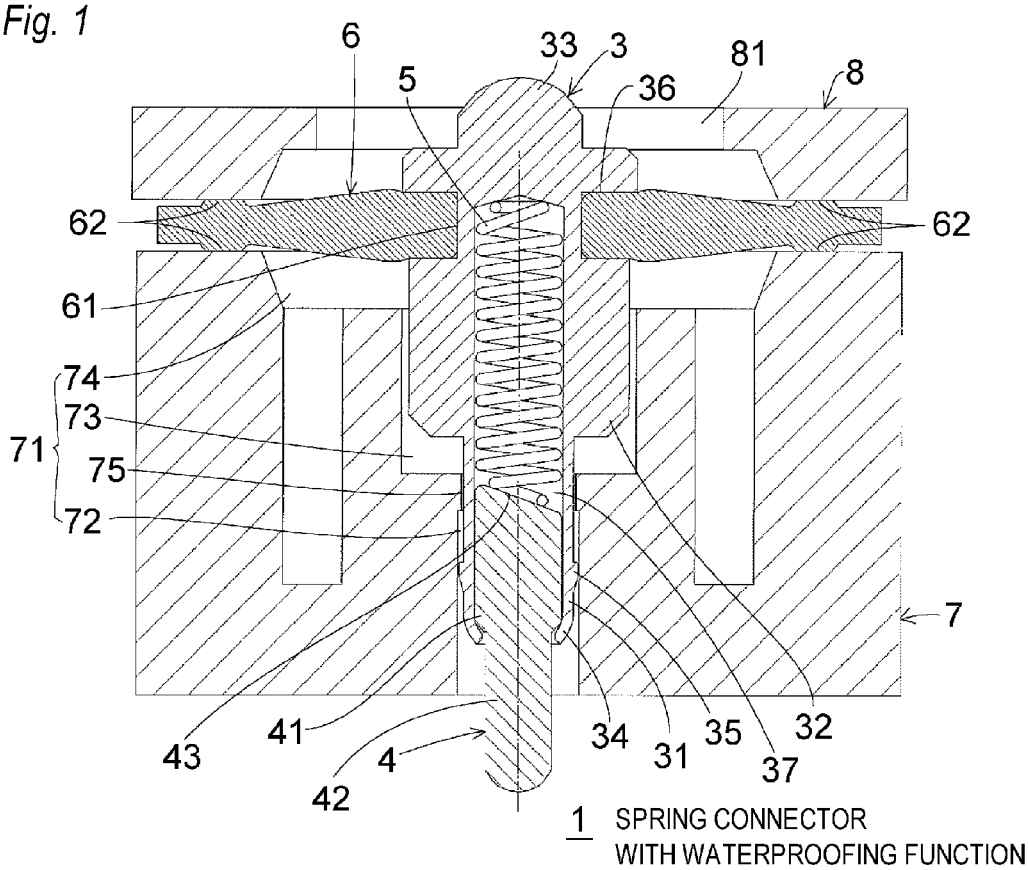
FIG. 1 is a sectional view of a spring connector 1 with waterproofing function in an unused state, according to Embodiment 1 of the invention.

Now, a preferred embodiment of the invention will be described in detail, referring to the drawings. It is to be noted that the same or equivalent constituent elements which are shown in the drawings are denoted with the same reference numerals, and overlapped descriptions are appropriately omitted. It is also to be noted that ratios of expansion and contraction are sometimes different between the respective drawings. Moreover, the embodiments do not limit the invention, but show only examples, and all the features and combinations of the features which are described in the embodiments are not necessarily essential matters of the invention.

Embodiment 1

Figure 2:
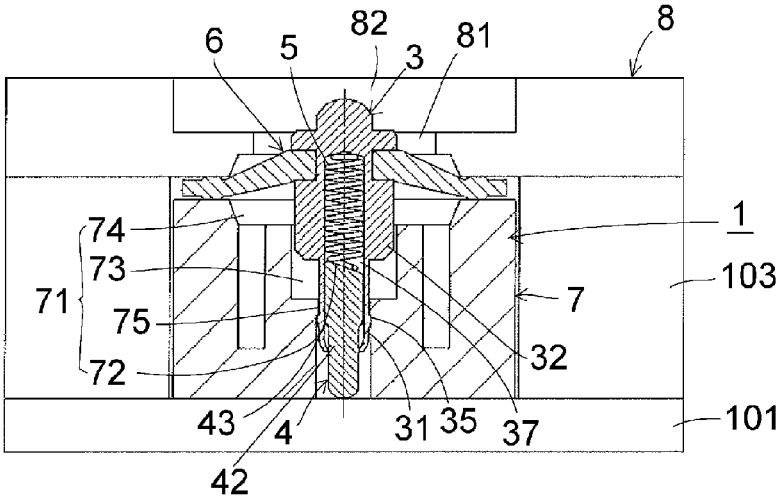
FIG. 2 is a sectional view of the spring connector 1 with waterproofing function in a state connected at one side.
Figure 3:
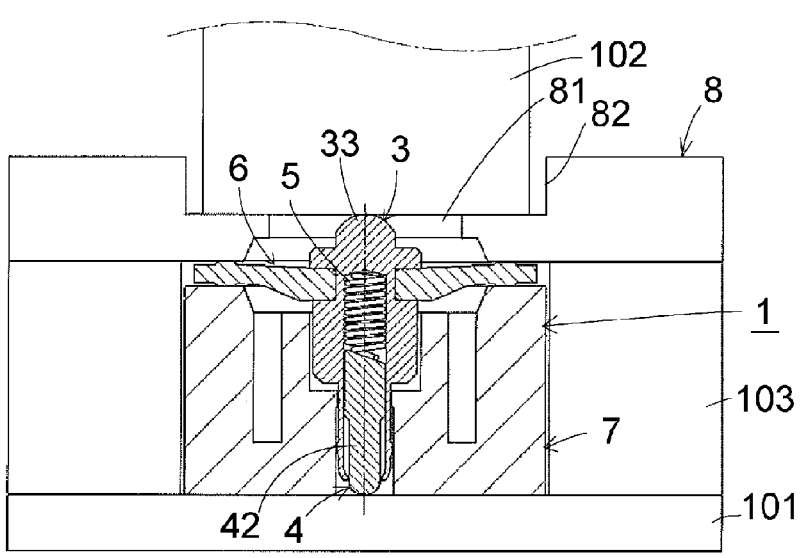
FIG. 3 is a sectional view of the spring connector 1 with waterproofing function in a state connected at both sides.
Figure 4A:
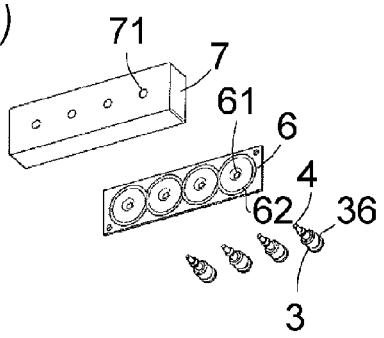
FIGS. 4(A) and 4(B) are exploded perspective views of the spring connector 1 with waterproofing function, as seen from opposite directions to each other.
Figure 4B:
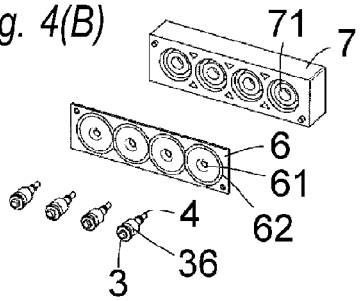
Figure 5A:
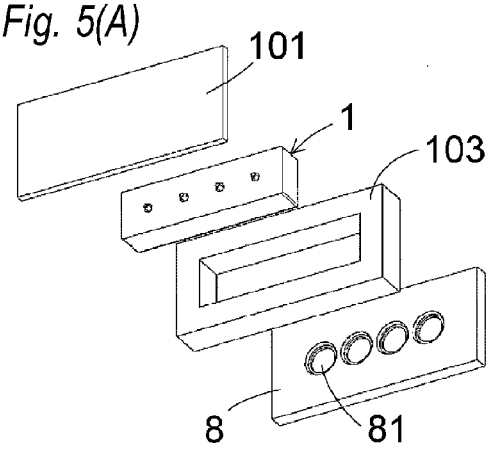
FIGS. 5(A) and 5(B) are exploded perspective views of a part of a device to which the spring connector 1 with waterproofing function is applied, as seen from opposite directions to each other.
Figure 5B:
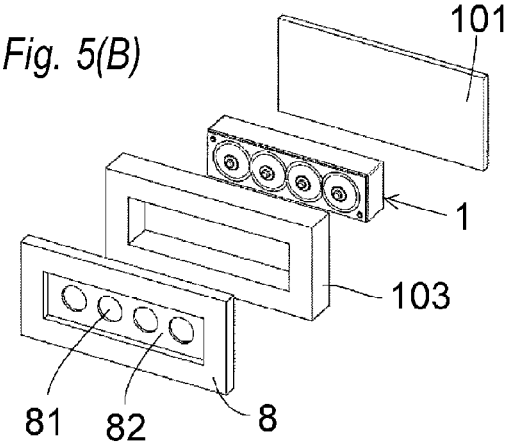

Embodiment 1 is shown in FIGS. 1 to 5(B). FIG. 1 is a sectional view of a spring connector 1 with waterproofing function in an unused state, according to Embodiment 1 of the invention. FIG. 2 is a sectional view of the spring connector 1 with waterproofing function in a state connected at one side. FIG. 3 is a sectional view of the spring connector 1 with waterproofing function in a state connected at both sides (a state in use). FIGS. 4(A) and 4(B) are exploded perspective views of the spring connector 1 with waterproofing function, as seen from opposite directions to each other. It is to be noted that a cover 8 is omitted in the drawings. FIGS. 5(A) and 5(B) are exploded perspective views of a part of a device to which the spring connector 1 with waterproofing function is applied, as seen from opposite directions to each other. In the drawings, the cover 8 is shown in a state separated from the spring connector 1 with waterproofing function.

The spring connector 1 with waterproofing function includes a conductive tube 3, a conductive pin 4, an insulating elastic member 6, a housing 7, and a cover 8. The conductive tube 3 is a conductive metallic body formed of copper alloy or the like, and to be connected to a battery 102, which is an example of an object to be connected at one side (See FIG. 3). The conductive pin 4 is a conductive metallic body formed of copper alloy or the like, and to be connected to a circuit board 101 of an object to be connected at the other side (a medical appliance such as an instillator, which is not shown) (See FIGS. 2 and 3). It is to be noted that in FIGS. 2 and 3, electrodes and conductive patterns of the circuit board 101 and the battery 102 are not shown.

The conductive tube 3 has a small diameter part 31, a large diameter part 32, and a contact part 33 in order from abase end side thereof. Abase end of the small diameter part 31 is opened and formed as a calked part 34. A convex part 35 is formed on a side face of the small diameter part 31. The convex part 35 encircles the side face of the small diameter part 31 at an intermediate position in an axial direction thereof. A concave groove 36 is formed on a side face of the large diameter part 32. The concave groove 36 encircles the side face of the large diameter part 32 at an intermediate position in an axial direction thereof. A hollow part 37 extending from an opening at the base end of the small diameter part 31 to the intermediate position in the axial direction of the large diameter part 32 forms an internal space in the conductive tube 3. A distal end of the contact part 33 is formed as a convex face such as a spherical face, and come into contact with the electrode of the battery 102, when the spring connector is used (See FIG. 3).

The conductive pin 4 has a large diameter part 41 and a small diameter part 42 in order from a base end side thereof. The large diameter part 41 has a larger diameter than a diameter of an opening in the caulked part 34 of the conductive tube 3, and can slide in the hollow part 37 of the conductive tube 3. A base end face of the large diameter part 41 is formed as an inclined face 43 which is inclined with respect to a plane perpendicular to an axial direction. The small diameter part 42 has a smaller diameter than the diameter of the opening in the caulked part 34 of the conductive tube 3, and protrudes from the caulked part 34. A distal end of the small diameter part 42 is formed as a convex face such as a spherical face, and come into contact with the electrode of the circuit board 101, when the spring connector is used (See FIGS. 2 and 3).

The spring 5 is a coil spring which is formed of general material such as piano wire or stainless steel wire, for example, and held inside the hollow part 37 of the conductive tube 3. One end of the spring 5 is in contact with a bottom face of the hollow part 37 of the conductive tube 3. The other end of the spring 5 presses the inclined face 43 of the conductive pin 4 thereby to urge the conductive pin 4 so as to protrude from the conductive tube 3. On this occasion, the large diameter part 41 of the conductive pin 4 is engaged with the caulked part 34 of the conductive tube 3 thereby to prevent withdrawal of the conductive pin 4 from the conductive tube 3.

The elastic member 6 is formed of rubber such as silicone rubber, and has a hole 61 through which the conductive tube 3 is inserted to come into tight contact with a side face of the conductive tube 3. The elastic member 6 is fitted into the concave groove 36 of the conductive tube 3 to come into elastic contact therewith, and spread in a flange-like shape from the side face of the conductive tube 3. In a stage before the elastic member 6 is fitted to the conductive tube 3 (in an unfitted state), a diameter of the hole 61 of the elastic member 6 is smaller than a diameter of a bottom face of the concave groove 36 of the conductive tube 3, and a thickness of the elastic member 6 in vicinity of the hole 61 is larger than a groove width of the concave groove 36. Accordingly, in a state where the elastic member 6 is fitted to the conductive tube 3, an inner face of the hole 61 is in elastic contact with the bottom face of the concave groove 36 of the conductive tube 3, at an entire circumference of the concave groove 36 of the conductive tube 3, and both faces of the elastic member 6 in vicinity of the hole 61 are respectively in elastic contact with both side faces of the concave groove 36 of the conductive tube 3. In this manner, the conductive tube 3 is fixed to the hole 61 of the elastic member 6 in tight contact thereby to prevent intrusion of water drops from the distal end side. The elastic member 6 has ring-like convex parts 62 which are partly enlarged in thickness, on both faces thereof, at a position separated from the side face of the conductive tube 3 by a predetermined distance.

The housing 7 is formed of insulating resin, for example, and has a hole 71 for slidably supporting the side face of the conductive tube 3 at a side closer to the base end than the elastic member 6. The hole 71 has a small diameter hole part 72, a large diameter hole part 73, and an open part 74 adjacent to the elastic member, which are continued in order from the base end side of the conductive tube 3. The small diameter part 31 of the conductive tube 3 is passed through the small diameter hole part 72, and the large diameter part 32 of the conductive tube 3 is passed through the large diameter hole part 73. It is to be noted that an edge at the base end side of the large diameter part 32 of the conductive tube 3 is chamfered, thus enabling the large diameter part 32 to be easily inserted into the large diameter hole part 73. The open part 74 adjacent to the elastic member is formed so as to have a larger diameter than the large diameter hole part 73, by a predetermined depth, so that deformation of the elastic member 6 along with sliding movement of the conductive tube 3 in the axial direction may not be hindered. In a state where the distal end of the conductive pin 4 is not in contact with the object, the distal end of the conductive pin 4 protrudes from the hole 71 in the housing 7. The small diameter hole part 72 is provided with a convex part 75 on its inner face. The convex part 75 encircles an inner face of the small diameter hole part 72 in vicinity of an end of the small diameter hole part 72 adjacent to the large diameter hole part 73. By engaging the convex part 75 of the housing 7 with the convex part 35 of the conductive tube 3, a maximal value of a protruding amount of the distal end of the conductive tube 3 is restricted.

The cover 8 is formed of insulating resin, for example, and covered over the housing 7 from the distal end side of the conductive tube 3, having a hole 81 for exposing the distal end of the conductive tube 3. In a state where the distal end of the conductive tube 3 is not in contact with the object, the distal end of the conductive tube 3 protrudes from the hole 81 in the cover 8. The convex parts 62 of the elastic member 6 are clamped and pressed between the housing 7 and the cover 8 from both sides in the axial direction of the conductive tube 3. In this manner, intrusion of water drops from gaps between the housing 7 and the cover 8 is prevented.

As shown in FIG. 2, a case 103 (formed of insulating resin, for example) in a frame-like shape is fixed to the circuit board 101 which is the object to be connected, and the spring connector 1 with waterproofing function is inserted into the case 103. The cover 8 is covered over the housing 7, by being fixed to the case 103. Moreover, a waterproofing structure is also provided between the cover 8 and the case 103, although not shown in the drawings.

When the spring connector 1 with waterproofing function is inserted into the case 103, the distal end of the conductive pin 4 comes into contact with the circuit board 101. On this occasion, the conductive tube 3 is urged by the spring 5 to slide along the hole 71 in the housing 7, until the convex part 35 of the small diameter part 31 is caught by (engaged with) the convex part 75 of the small diameter hole part 72 in the housing 7. Thereafter, the conductive pin 4 slides to retreat in the hollow part 37 in the conductive tube 3, resisting an urging force of the spring 5 (while pressing and contracting the spring 5). In this manner, a protruding amount of the distal end of the conductive tube 3 is controlled at a constant value, and at the same time, a contact pressure of the distal end of the conductive pin 4 with respect to the electrode of the circuit board 101 is sufficiently secured. Moreover, on this occasion, abase end side of the large diameter part 32 of the conductive tube 3 remains inside the large diameter hole part 73 in the housing 7. For this reason, when the distal end of the conductive tube 3 is pushed in, thereafter, as shown in FIG. 3, the large diameter part 32 of the conductive tube 3 is prevented from interfering with an upper end of the large diameter hole part 73 in the housing 7. Further, when the spring 5 presses the base end face (the inclined face 43) of the conductive pin 4, the conductive pin 4 is tilted, and a side face of the large diameter part 41 at the base end side of the conductive pin 4 is pressed against an inner face of the hole part 37 in the conductive tube 3. As the results, the conductive tube 3 is reliably brought into contact with the conductive pin 4 to be electrically continued.

The spring connector 1 with waterproofing function is mounted on the circuit board 101, as shown in FIG. 2, and then, the battery 102 is mounted on the conductive tube 3 from the distal end side, as shown in FIG. 3. The cover 8 is formed with a recess 82 having a shape corresponding to a shape of the battery 102. The battery 102 is inserted along the recess 82, until it comes into contact with a bottom face of the recess 82. Then, the conductive tube 3 protruding from the hole 81 in the cover 8 (protruding from the bottom face of the recess 82) retreats resisting the urging force of the spring 5 (while contracting the spring 5), until the distal end of the conductive tube 3 is contacted and pressed with the electrode of the battery 102 thereby to come into alignment with an open end of the hole 81 (the bottom face of the recess 82). In this manner, electrical continuity between the circuit board 101 and the battery 102 is established. Even though the conductive tube 3 further retreats, the large diameter part 32 of the conductive tube 3 is butted against a step part between the large diameter hole part 73 and the small diameter hole part 72 in the housing 7, and thus, the further retreat of the conductive tube 3 is hindered. Therefore, it is possible to prevent damage of the caulked part 34 of the conductive tube 3 when it comes into contact with the circuit board 101.

In order to assemble the spring connector 1 with waterproofing function, as a first step, the spring 5 and the large diameter part 41 of the conductive pin 4 are inserted into the hollow part 37 in the conductive tube 3, and the base end of the conductive tube 3 is caulked to form the caulked part 34, thereby to integrate these three members in a form of an assembly. A plurality of these assemblies are prepared. The holes 61 in the elastic members 6 are fitted to the concave grooves 36 in the respective conductive tubes 3, and they are inserted in the holes 71 in the housing 7 (See FIGS. 4(A) and 4(B)). On this occasion, base end sides of the convex parts 35 of the conductive tubes 3 are engaged with the convex parts 75 of the small diameter hole parts 72 in the housing 7. However, by pushing the conductive tubes 3 from the distal end side, the convex parts 35 of the conductive tubes 3 override the convex parts 75 of the small diameter hole parts 72 from above to below in the drawings (because the housing 7 is elastically deformed slightly in a part). In this manner, the spring connector 1 with waterproofing function is completed. It is to be noted that the cover 8 is attached later, when the spring connector 1 is mounted on the circuit board 101. Moreover, the convex parts 35 of the conductive tubes 3 are reduced in diameter in a taper shape toward the base ends. Therefore, the convex parts 35 relatively easily override the convex parts 75 of the small diameter hole parts 72 from the above to the below in the drawings, but cannot easily override from the below to the above in the drawings (in short, the conductive tubes 3 are not withdrawn from the holes 71 in the housing 7). Moreover, by setting such dimensional relation that parts of the base end sides of the large diameter parts 32 of the conductive tubes 3 are contained in the large diameter hole parts 73 in the housing 7, in a state where the base end sides of the convex parts 35 of the conductive tubes 3 are engaged with the convex parts 75 of the small diameter hole parts 72 in the housing 7, it is possible to temporarily position a plurality of the conductive tubes 3 in the holes 71 in the housing 7 with ease, and assembling workability is enhanced.

In order to mount the spring connector 1 with waterproofing function on the circuit board 101, after the case 103 is fixed to the circuit board 101, the spring connector 1 with waterproofing function (except the cover 8) is inserted into the case 103, and then, the cover 8 is fixed to the case 103 (See FIGS. 5(A) and 5(B)).

According to this embodiment, although the elastic member 6 is attached to the conductive tube 3, an elastic member for waterproofing is not attached to the conductive pin 4. Therefore, the conductive pin 4 can be freely tilted, as compared with a case where the drip-proofing cover hinders the tilting movement of the movable pin, like the drip-proofing connector as described in Patent Document 1. For this reason, the conductive pin 4 which is pushed by the spring 5 is easily tilted as compared with the movable pin in Patent Document 1, and the side face of the large diameter part 41 can be brought into contact with the inner face of the hollow part 37 in the conductive tube 3 with sufficient side pressure. Accordingly, more reliable contact can be obtained, as compared with the drip-proofing connector in Patent Document 1, and the spring connector 1 with waterproofing function which is excellent in conductivity and low resistance is realized.

Embodiment 2

Figure 6:
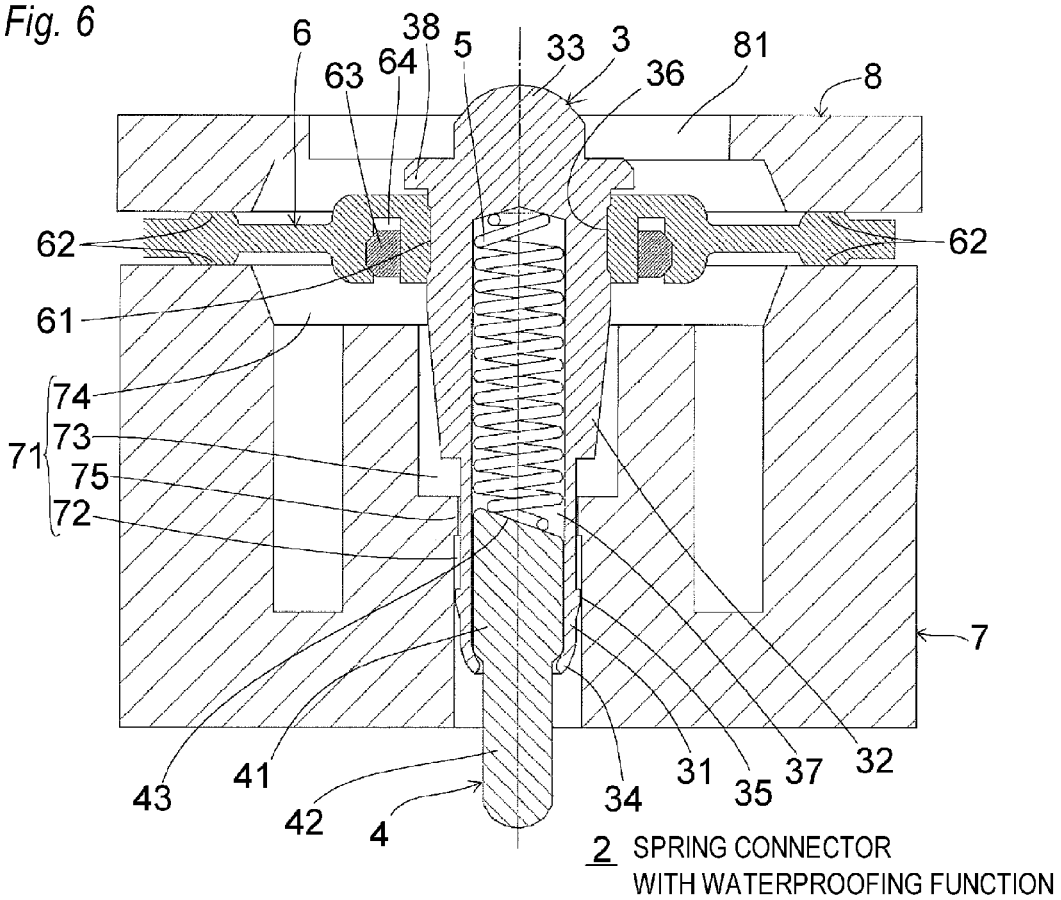
FIG. 6 is a sectional view of a spring connector 2 with waterproofing function, according to Embodiment 2 of the invention.
Figure 7:
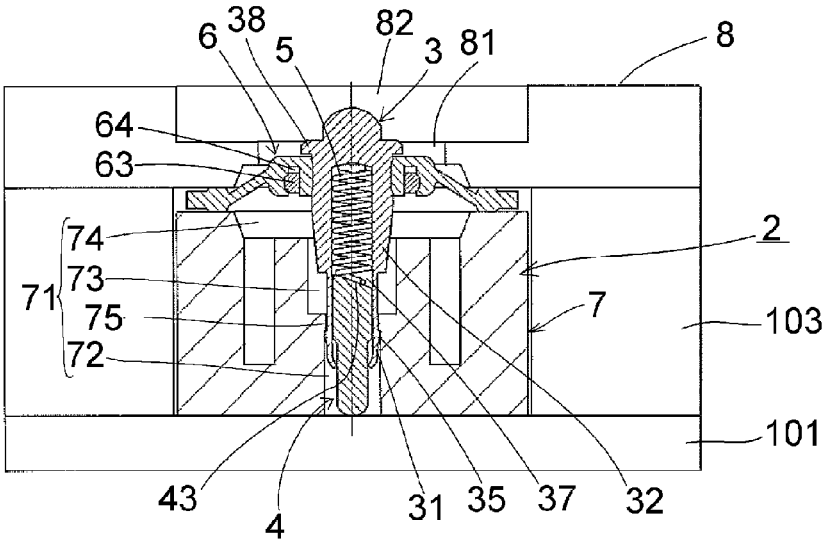
FIG. 7 is a sectional view of the spring connector 2 with waterproofing function in a state connected at one side.
Figure 8:
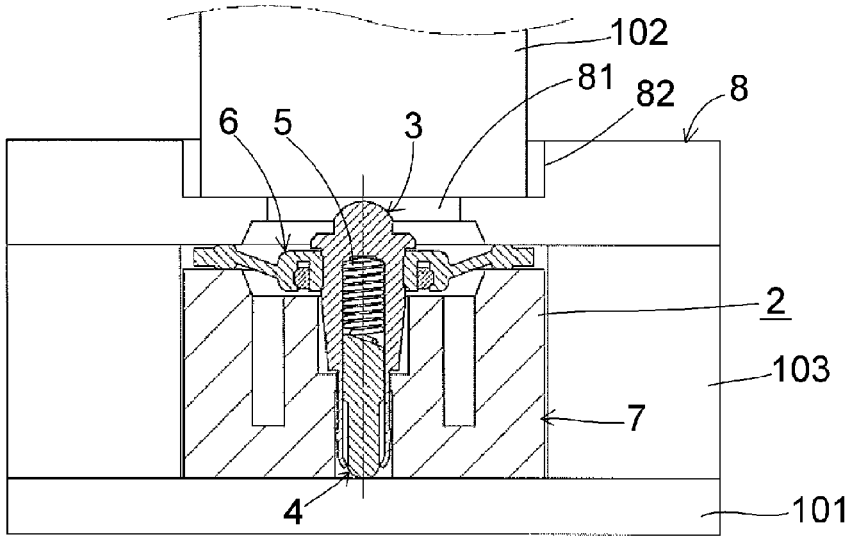
FIG. 8 is a sectional view of the spring connector 2 with waterproofing function in a state connected at both sides.
Figure 9A:
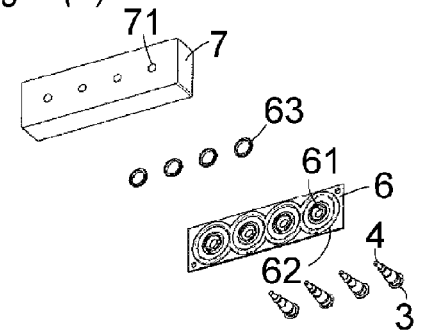
FIGS. 9(A) and 9(B) are exploded perspective views of the spring connector 2 with waterproofing function, as seen from opposite directions to each other.
Figure 9B:
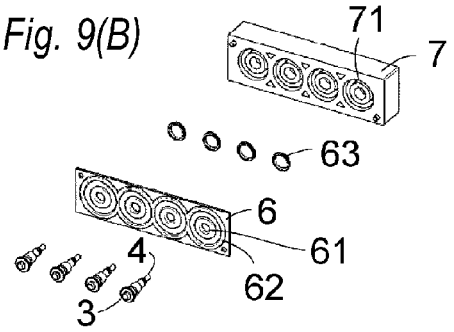
Figure 10A:
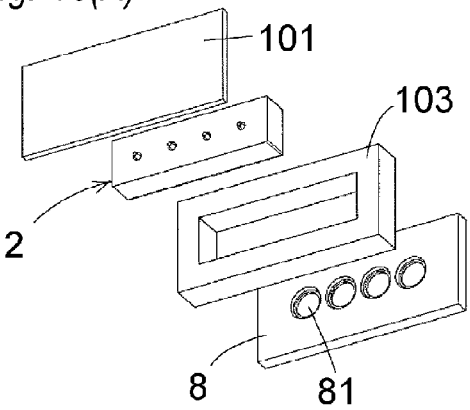
FIGS. 10(A) and 10(B) are exploded perspective views of a part of a device to which the spring connector 2 with waterproofing function is applied, as seen from opposite directions to each other.
Figure 10B:
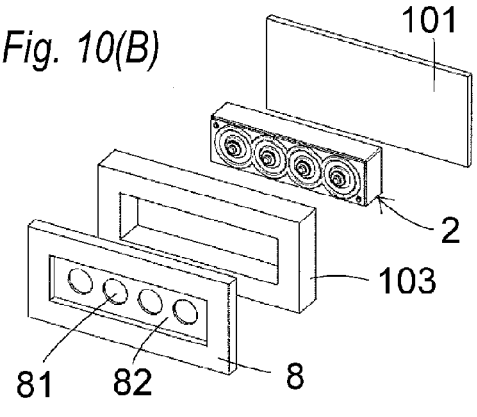

Embodiment 2 is shown in FIGS. 6 to 10(B). FIG. 6 is a sectional view of a spring connector 2 with waterproofing function according to Embodiment 2 of the invention. FIG. 7 is a sectional view of the spring connector 2 with waterproofing function in a state connected at one side. FIG. 8 is a sectional view of the spring connector 2 with waterproofing function in a state connected at both sides (a state in use). FIGS. 9(A) and 9(B) are exploded perspective views of the spring connector 2 with waterproofing function, as seen from opposite directions to each other. It is to be noted that the cover 8 is omitted in the drawings. FIGS. 10(A) and 10(B) are exploded perspective views of a part of a device to which the spring connector 2 with waterproofing function is applied, as seen from opposite directions to each other. In these drawings, the cover 8 is shown in a state separated from the spring connector 2 with waterproofing function.

In this embodiment, different from Embodiment 1, the elastic member 6 has a thick wall part around the hole 61, and a ring-like groove 64 is formed in this thick wall part. Moreover, a non-elastic ring 63 formed of metal, for example, which surrounds the hole 61 is fitted into the ring-like groove 64 in the elastic member 6. In this manner, the conductive tube 3 is fixed to the hole 61 in the elastic member 6 in tight contact, thereby to form a waterproofing structure. The non-elastic ring 63 has a function of enhancing rigidity of the elastic member 6 in vicinity of the hole 61. It is to be noted that the non-elastic ring 63 may be integrally formed with the elastic member 6 by insert molding, for example. Because the elastic member 6 is provided with the non-elastic ring 63, a depth of the concave groove 36 of the conductive tube 3 is made remarkably shallow, as compared with Embodiment 1, and a main function of the concave groove 36 is to prevent displacement of the elastic member 6. Specifically, because the rigidity is increased by the non-elastic ring 63, sufficient waterproofing function is obtained only by the elastic contact between the inner face of the hole 61 in the elastic member 6 and the side face of the large diameter part 32 of the conductive tube 3. Moreover, a flange part 38 is formed at the distal end of the large diameter part 32 of the conductive tube 3 for the purpose of preventing withdrawal of the elastic member 6. Other features in this embodiment are substantially the same as those in Embodiment 1. According to this embodiment, in the same manner as Embodiment 1, the spring connector 2 with waterproofing function which is capable of making more reliable contact, as compared with the drip-proofing connector in Patent Document 1, and which is excellent in conductivity and low resistance is realized.

Although the invention has been heretofore described referring to the embodiments, it is to be understood by those skilled in the art that various modifications can be added to respective constituent elements and working processes in the embodiments, within a scope described in the claims.

DESCRIPTION OF REFERENCE NUMERALS AND SIGNS

1, 2 Spring connector with waterproofing function
3 Conductive tube
4 Conductive pin
5 Spring
6 Elastic member
7 Housing
8 Cover
34 Caulked part
35 Convex part
36 Concave groove
43 Inclined face
71 Hole
75 Convex part

101 Circuit board
102 Battery
103 Case

The invention claimed is:

1. A spring connector with waterproofing function comprising:

a conductive tube having a distal end which is a contact part to be contacted with an object at one side;

a conductive pin having a distal end which is a contact part to be contacted with an object at the other side, and protruded from an opening at a base end of the conductive tube, a base end of the conductive pin which is contained in the conductive tube and can slide with respect to the conductive tube, a part of a base end face of the conductive pin which is formed as an inclined face that is inclined with respect to a plane perpendicular to an axial direction;

a spring held inside the conductive tube, and pressing the inclined face of the conductive pin to urge the conductive pin so as to protrude from the conductive tube;

an elastic member having a hole into which the conductive tube is inserted to be brought into tight and elastic contact with a side face of the conductive tube, the elastic member being spread in a flange-like shape from the side face of the conductive tube; and a housing having a hole for slidably supporting at least a part of the side face of the conductive tube at a side closer to the base end than the elastic member, wherein the distal end of the conductive pin can protrude from the hole in the housing, in a state where the distal end of the conductive pin is not in contact with the object.

2. The spring connector with waterproofing function as claimed in claim 1, wherein the side face of the conductive tube and an inner face of the hole of the housing are respectively provided with convex parts, and by engaging the convex parts with each other, a maximal value of a protruding amount of the distal end of the conductive tube is restricted.

3. The spring connector with waterproofing function as claimed in claim 2, wherein the convex part of the conductive tube has a taper part which is reduced in diameter in a taper shape toward the base end side, and the conductive tube can be inserted into the hole of the housing from the base end side.

4. The spring connector with waterproofing function as claimed in claim 1, wherein the hole of the housing has a small diameter hole part and a large diameter hole part which are continued in order from the base end side of the conductive tube, the conductive tube has a small diameter part which is positioned or extended inside the small diameter hole part, and a large diameter part which is positioned or extended inside the large diameter hole part, and when the distal end of the conductive pin is pushed in so as not to protrude from the hole, a part of the large diameter part of the conductive tube remains in the large diameter hole part.

5. The spring connector with waterproofing function as claimed in claim 1, further comprising a cover having a hole for exposing the distal end of the conductive tube, and covered over the housing from the distal end side of the conductive tube, wherein the distal end of the conductive tube can protrude from the hole of the cover, in a state where the distal end of the conductive tube is not in contact with the object, and wherein the elastic member is clamped and pressed between the housing and the cover from both sides of an axial direction of the conductive tube.

6. The spring connector with waterproofing function as claimed in claim 1, wherein the conductive tube has a concave groove which encircles the side face of the conductive tube, and the elastic member is fitted into the concave groove in elastic contact with the concave groove.

7. The spring connector with waterproofing function as claimed in claim 6, wherein the elastic member is in elastic contact with a bottom face and both side faces of the concave groove at an entire circumference of the concave groove.

8. The spring connector with waterproofing function as claimed in claim 1, wherein a non-elastic ring which surrounds an outside of the hole of the elastic member is integrally provided with the elastic member or is fitted into the elastic member.

9. The spring connector with waterproofing function as claimed in claim 1, wherein the base end of the conductive tube is formed as a caulked part, while the conductive pin has a large diameter part having a larger diameter than an inner diameter of the caulked part, at the base end side, and by engaging the large diameter part of the conductive pin with the caulked part, withdrawal of the conductive pin from the conductive tube is prevented.

10. The spring connector with waterproofing function as claimed in claim 1, wherein, when the distal end of the conductive pin is pushed and the spring is contracted, a side face of the conductive pin at the base end side is pressed against an inner face of the conductive tube.

* * * * *